United States Patent [19]

Eschenbach

[11] 4,137,601

[45] Feb. 6, 1979

[54] DEVICE FOR SCRUBBING SURFACES

[75] Inventor: Paul W. Eschenbach, Moore, S.C.

[73] Assignee: Milliken Research Corporation, Spartanburg, S.C.

[21] Appl. No.: 821,164

[22] Filed: Aug. 2, 1977

[51] Int. Cl.[2] ..... A47L 9/04

[52] U.S. Cl. ..... 15/380; 15/49 RB; 15/320

[58] Field of Search ..... 15/49 RB, 50 A, 320, 15/380, 381

[56] References Cited

U.S. PATENT DOCUMENTS

| | | | |
|---|---|---|---|
| 1,538,637 | 5/1925 | Jessen etal. | 15/320 X |
| 1,900,122 | 3/1933 | Mason | 15/381 |
| 2,364,608 | 12/1944 | Edwards | 15/320 X |
| 2,384,458 | 9/1945 | Dubay | 15/320 X |
| 2,514,142 | 7/1950 | Reid | 15/381 X |
| 3,375,540 | 4/1968 | Hyde | 15/320 |
| 4,019,662 | 4/1977 | Dana | 222/414 |

FOREIGN PATENT DOCUMENTS

| | | | |
|---|---|---|---|
| 1104830 | 6/1955 | France | 15/49 RB |
| 399174 | 9/1933 | United Kingdom | 15/380 |
| 1070175 | 6/1967 | United Kingdom | 15/320 |

*Primary Examiner*—Christopher K. Moore

*Attorney, Agent, or Firm*—Robert S. Alexander; H. William Petry

[57] ABSTRACT

A device for scrubbing carpets having an augularly oscillating scrubber mounted on a frame.

5 Claims, 19 Drawing Figures

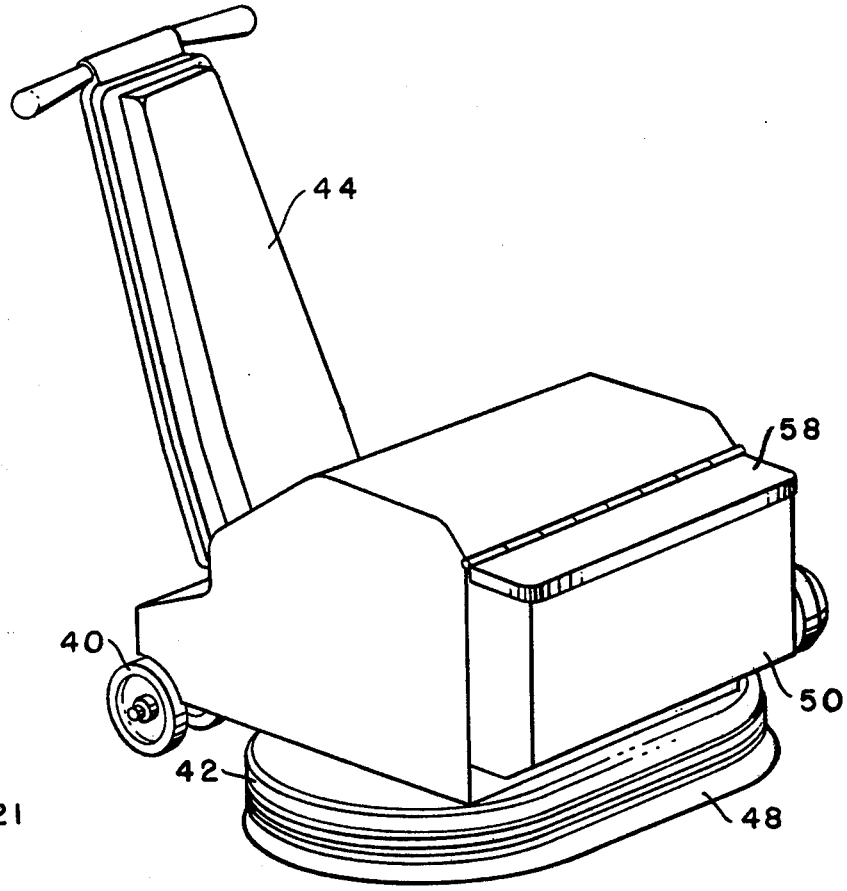
FIG. 10
FIG. 13
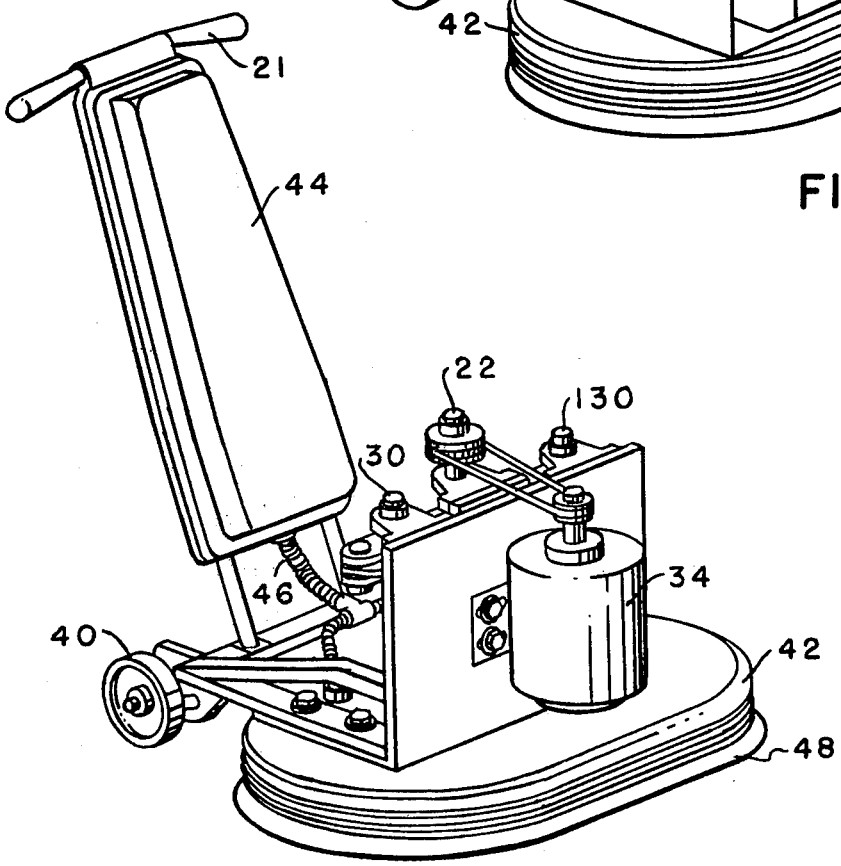

DEVICE FOR SCRUBBING SURFACES

BACKGROUND OF THE INVENTION

Many consider wall-to-wall carpeting to be the peak of luxury; housewives love it for the warm atmosphere it brings, businessmen value it for the air of corporate dignity it lends their offices; but to those who must clean and maintain it, wall-to-wall carpeting is an immense headache. It must be cleaned in place; the cleaning must be accomplished in a relatively short time and if the carpet is not kept scrupulously clean, its life may be severely shortened. For these reasons, the carpet cleaning industry is constantly seeking improved methods and machinery for cleaning carpets.

Recently, a radically new approach to cleaning carpets has been developed which uses a powdered cleaning composition containing a mixture of extremely porous solid particles and a solvent. This new cleaning composition is described in U.S. Pat. No. 4,013,594 and has proved especially effective in removing soil from carpets. Further, only a short interval is required between application and removal of the powdered cleaning composition. Using this new cleaning composition, it has now become possible to clean wall-to-wall carpets in offices and stores during working hours with little disruption of normal affairs. However, this progress in cleaning compositions has exposed shortcomings in the carpet cleaning machines known to the prior art.

When the devices which are known to the prior art are used with this new powdered cleaning composition, it is found that some areas of the carpet are cleaned much better than other areas and that a streaked appearance results. It is theorized that this streaked appearance is due to the fact that the powder, unlike a liquid, must be physically moved into intimate contact with the fibers to be cleaned. Therefore, to obtain the full benefit of the powdered cleaning composition, it is thought to be desirable to provide a device which is capable of transmitting a great deal of energy to the carpet in order to bring the powdered cleaning composition into intimate contact with the fiber while distributing this energy uniformly over the area which is scrubbed.

It has been discovered that this can be accomplished by providing a device having an angularly oscillating scrubber element, which imparts a back and forth motion to the fibers. It is thought that this motion enables the particles to quickly work their way into intimate contact with the fibers and thus clean them.

BRIEF DESCRIPTION OF THE DRAWINGS

FIG. 10 is a perspective view of the machine with the cover removed;

FIG. 13 is a perspective view of the machine of FIGS. 11 and 12;

DESCRIPTION OF THE PREFERRED EMBODIMENT

Figure 1:
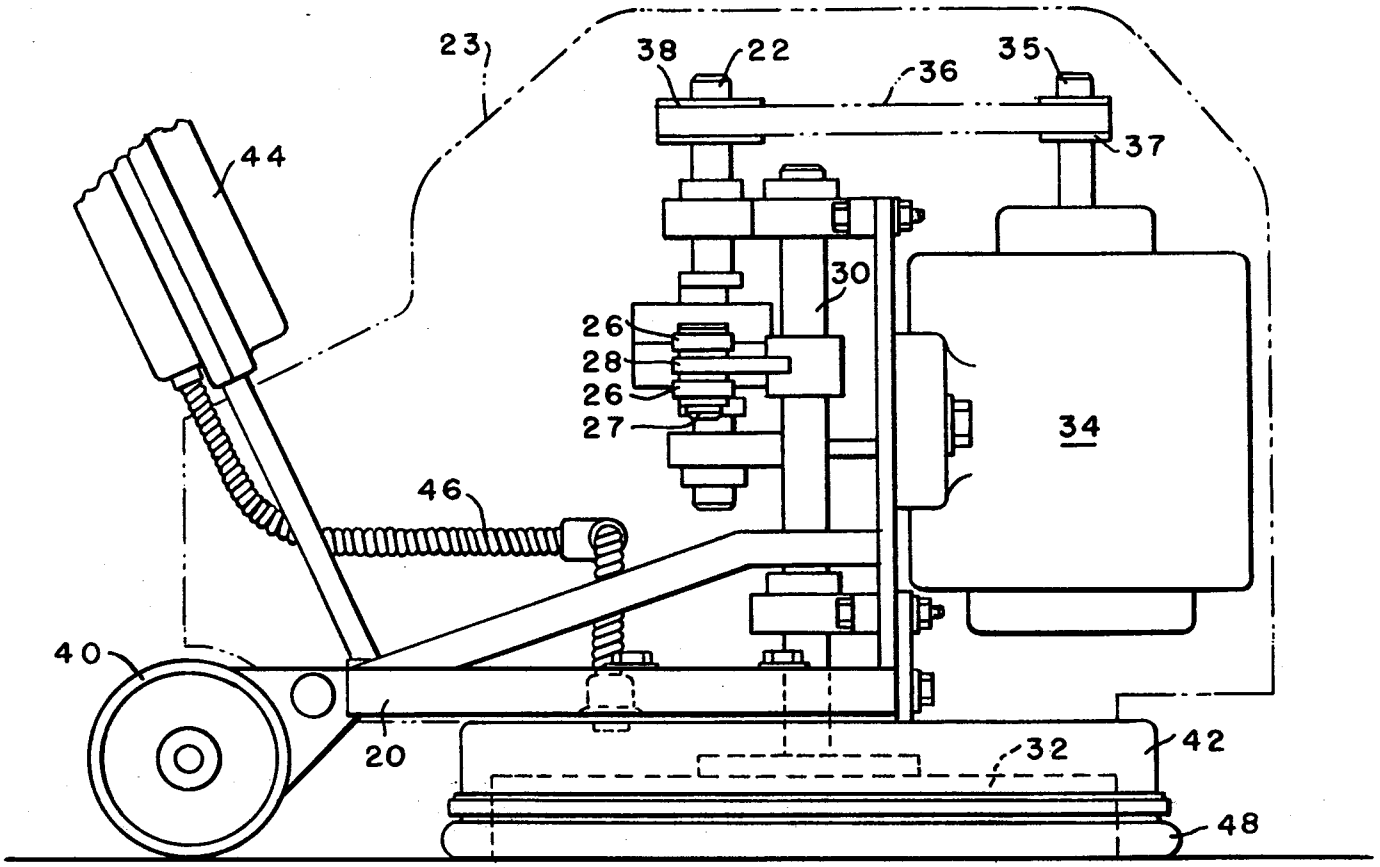
FIG. 1 is a schematic side elevation of the carpet scrubbing machine with cover shown in phantom.
Figure 2:
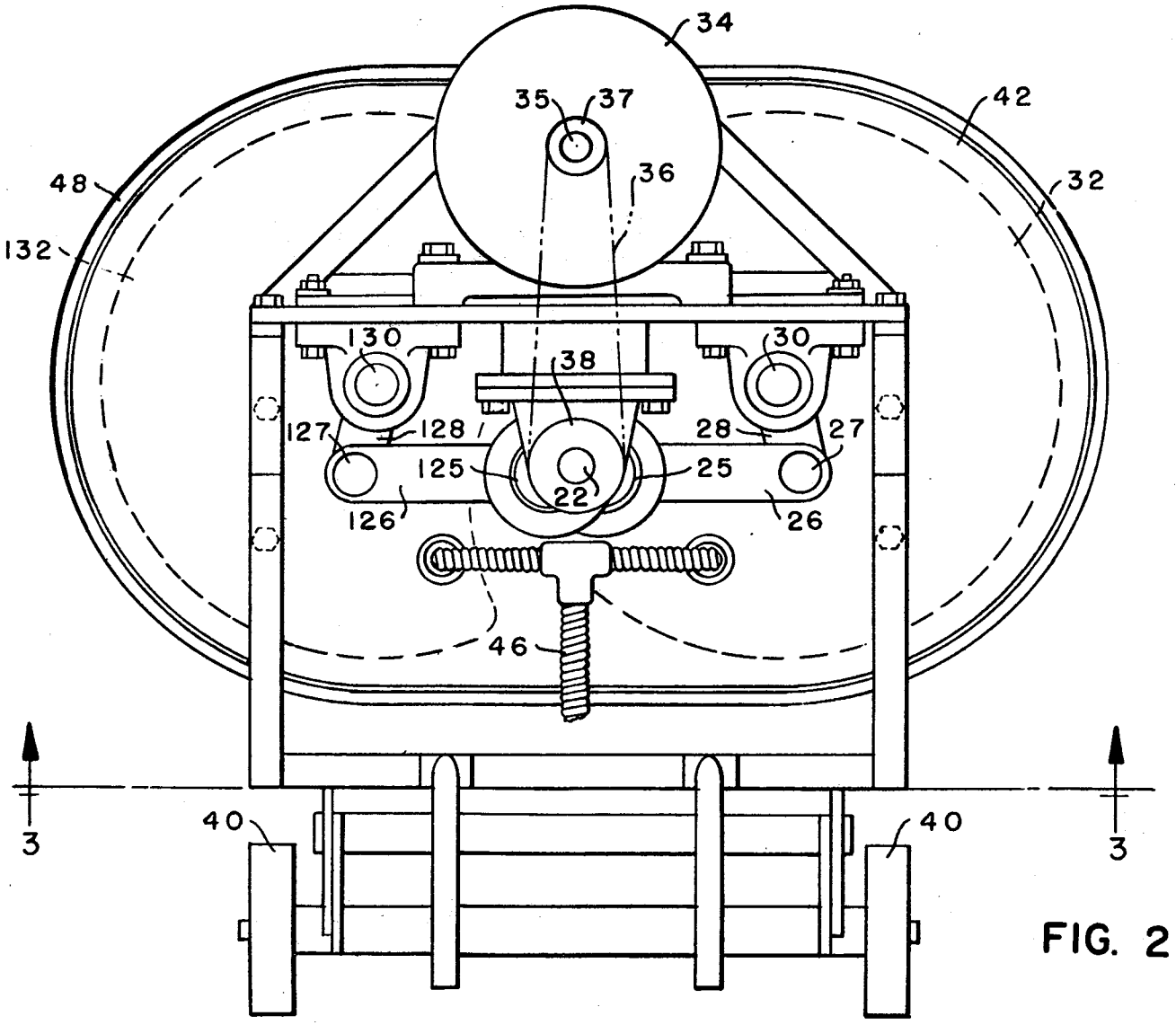
FIG. 2 is a schematic top view of the carpet scrubbing machine of FIG. 1 with cover removed.
Figure 4:
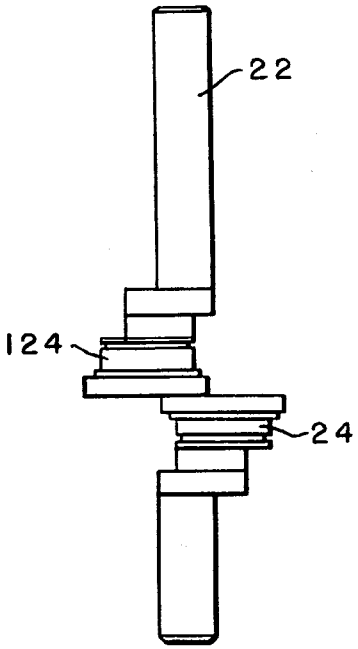
FIG. 4 is a detailed view showing the crankshaft of the present machine.
Figure 3:
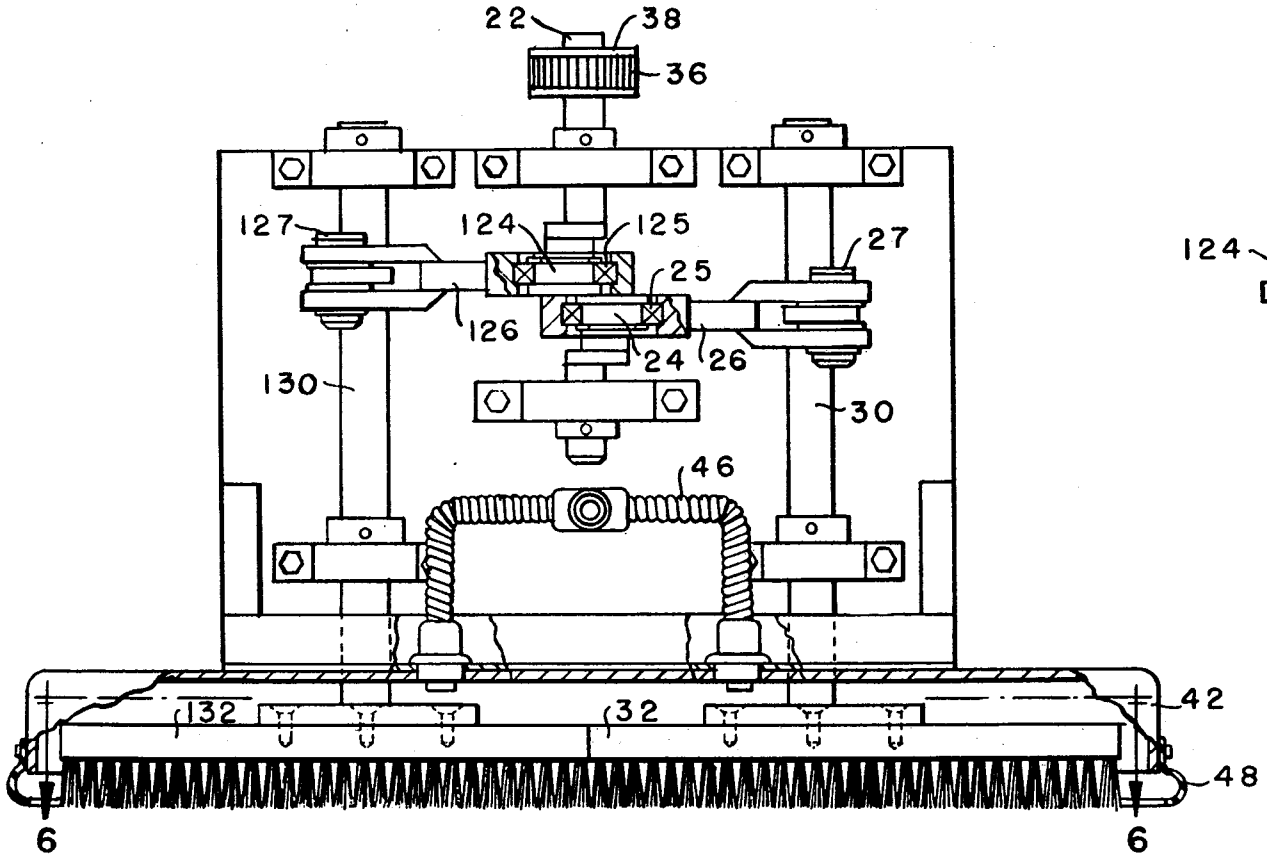
FIG. 3 is a view taken along section line 3—3 of FIG. 2.
Figure 5:
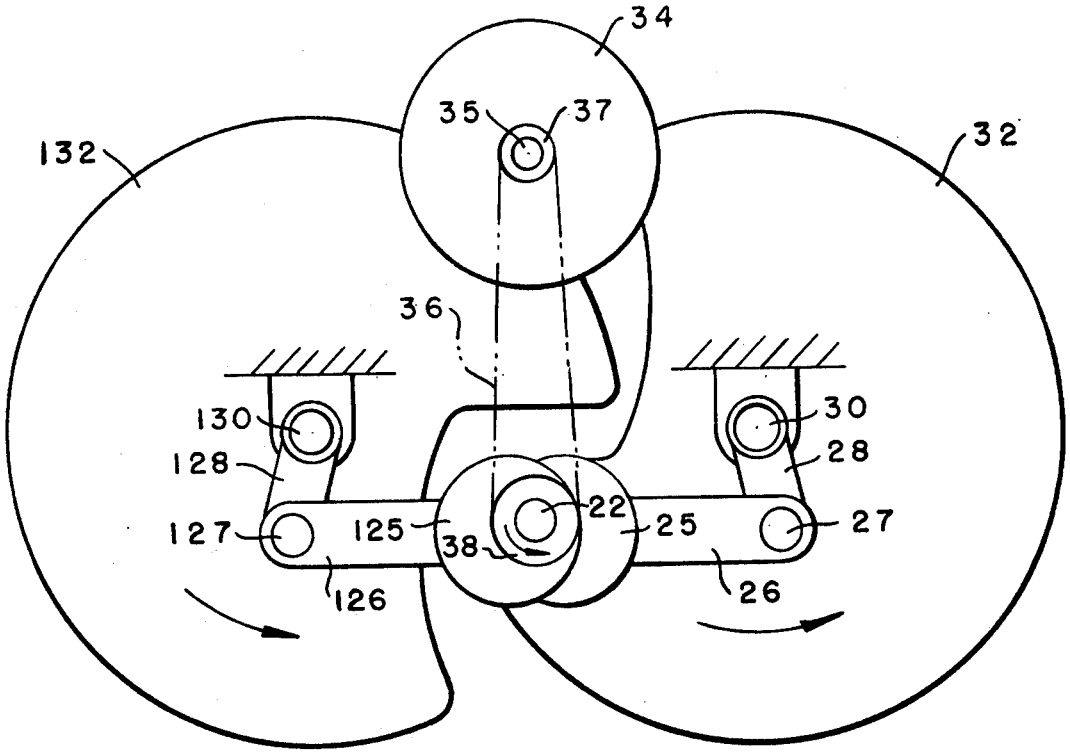
FIG. 5 is a schematic showing the linkage by which angular oscillatory movement is obtained.

In FIGS. 1-5, motor 34 having armature 35 is mounted on frame 20. Belt 36 engages sheave 37 which is mounted on armature 35. Belt 36 also engages pulley 38 which is mounted on crankshaft 22. Pulley 38 is connected to brushes 32 and 132 by means of a pair of crank and rocker mechanisms. The crank and rocker mechanisms comprise crankshaft 22 which as shown in FIG. 4 has offset driving portions 24 and 124. Offset driving portion 24 is encircled by bearing 25 which is attached to the end of coupling link 26. Coupling link 26 is pivotably joined to rocking link 28 by pin 27. Rocking link 28 is rigidly attached to shaft 30 which in turn is connected to scrubbing element 32. Similarly, offset driving portion 124 is encircled by bearing 125 which is attached to the end of coupling link 126. Coupling link 126 is pivotably attached to rocking link 128 by pin 127. Rocking link 128 is rigidly attached to shaft 130 which drives scrubbing element 132.

Figure 8:
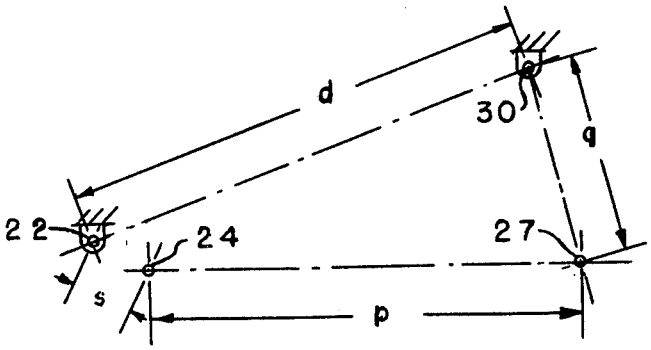
FIG. 8 is a kinematic diagram of the linkage of FIG. 5.

Advantageously, driving portions 24 and 124 of crankshaft 22 will be offset from the centerline of the crankshaft in opposite directions, thus coupling links 26 and 126 will be driven 180° out of phase from each other. For each crank and rocker mechanism it is useful to define two quantities called the transmission angles, one of which is defined to be the angle between the axis of the rocking link and the normal to the coupling link when the pin is at its maximum distance away from the centerline of the crankshaft and the other of which is similarly defined when the pin is at the minimum distance from the centerline of the crankshaft. It is advantageous to adjust each crank and rocker mechanism so that its transmission angles are equalized. For example, referring to FIGS. 5 and 8, for the crank and rocker mechanism defined by offset driving portion 24, coupling link 26 and rocking link 28, the transmission angles are equalized by sizing the components so that the following conditions are met: let s be the distance between the centerline of crankshaft 22 and the centerline of offset driving portion 24;

let p be the distance between the centerline of offset driving portion 24 and the centerline of pin 27;

let q be the distance between the centerline of pin 27 and the centerline of shaft 30;

let d be the distance between the centerline of shaft 30 and the centerline of crankshaft 22;

then, if $s^2 + d^2 = p^2 + q^2$, the crank and rocker mechanism will have equal transmission angles. Absolute equality of the transmission angles is not required, but it is desirable that they be as close to equal as is possible. The same relationship should also hold for the crank and rocker mechanism defined by offset driving portion 124, coupling 126 and rocking link 128.

It is also advantageous to locate shafts 30 and 130 so that coupling link 26 will be colinear with coupling link 26 when pins 27 and 127 are at the maximum distance from the centerline of crankshaft 22.

If the above conditions are met, then each scrubber element will spend the same amount of time going clockwise as it spends going counterclockwise and, more importantly, the machine will be force balanced. Thus, the tendency of the machine to walk will be minimized and only minimum counterweighting will be required to compensate for unbalanced forces in the linkages. This will lead to longer bearing life and decreased operator fatigue.

Figure 6:
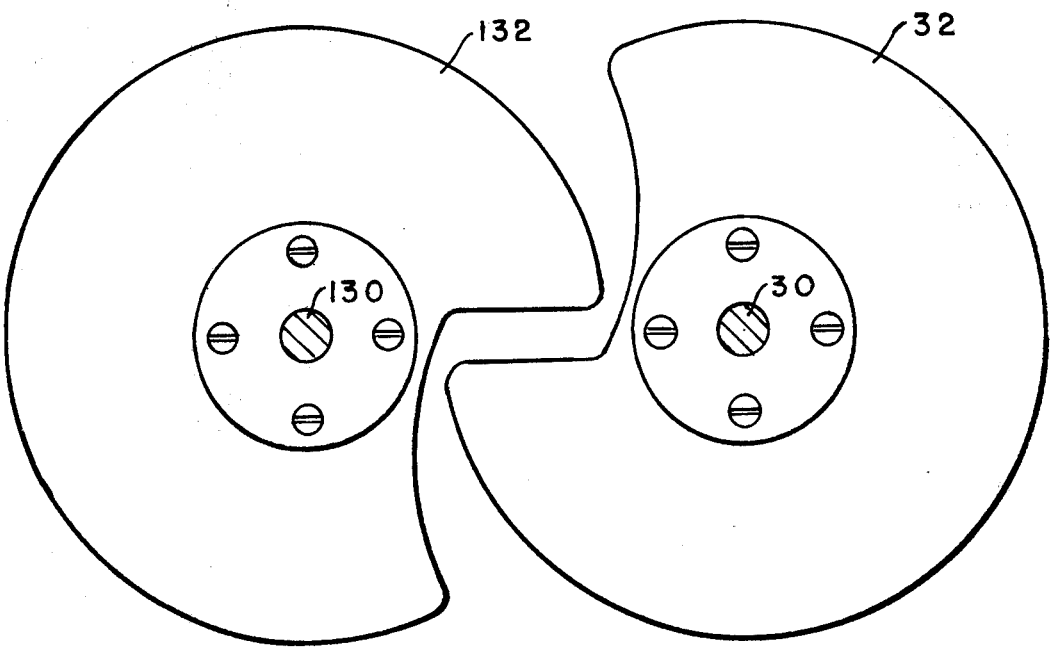
FIG. 6 is a sectional view along line 6—6 in FIG. 3.

As shown in FIG. 6, brushes 32 and 132 are substantially circular but have cutaway or recessed portions so that as they angularly oscillate, they alternately scrub overlapping areas but do not collide with each other. It has been found that this configuration produces unexpectedly uniform cleaning efficiency across the width of the machine while at the same time it provides an unexpectedly high level of input of energy into the carpet while not seriously degrading or damaging the fibers of the carpet. It is preferred that the brushes angularly oscillate in the range of about 800 to about 1500 cycles per minute through a range of about 25 to 45 degrees.

While the shape shown in FIG. 6 is one preferred configuration of the scrubber elements 32 and 132, many other configurations are also suitable. It is desirable only that the brushes are cut away so that they scrub substantially overlapping segments of the carpet while being shaped so that they do not collide with each other as they angularly oscillate.

Figure 7:
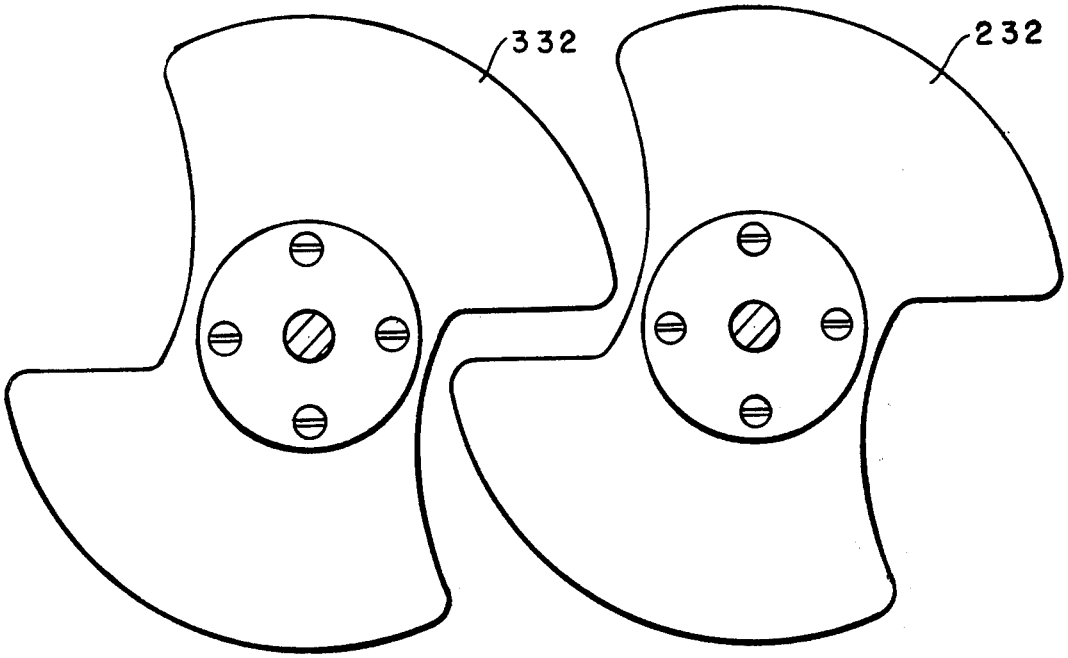
FIG. 7 is a top view of an alternate configuration for brushes.

The scrubber elements 232 and 332 shown in FIG. 7 are preferred over those in FIG. 6 because they do not generate unbalanced forces. Since the brushes shown in FIG. 7 have two recessed regions which have the same shape but are spaced 180° from each other, no counterweight is required and the center of the frictional force between the carpet and the brush is close to the center of the brush. This result can be obtained whenever the two recessed regions have the same area, have the same polar moment of area and the centroids of the two regions are located at the same distance from the axis of angular oscillation but are displaced 180° from each other. When motor 34 is activated, it drives belt 36 which in turn drives crankshaft 22 acting through the crank and rocker mechanisms which angularly oscillate shafts 30 and 130 causing brushes 32 and 132 to angularly oscillate about their axes of rotation through angles of approximately 25 to 45 degrees. It has been found that this arrangement produces a relatively uniform cleaning across the width of the machine and minimizes streaking effects which often occur from uneven cleaning.

If the weight of the machine is supported entirely by the brushes, it has been found that the best results are obtained if the center of gravity of the scrubber is located as close as possible to the midpoint of the line between the shafts 30 and 130; however, it is not essential that the center of gravity be exactly over the midpoint but preferably it will be located over the area of the scrubber elements. If this condition is met, the scrubber will exhibit substantially uniform cleaning efficiency and the scrubber will be easily movable while operating. It has been found that the uniformity of cleaning may be made relatively independent of the location of the center of gravity of the machine by providing wheels 40 at the rear of the machine to help support the machine and hold it level.

Figure 9:
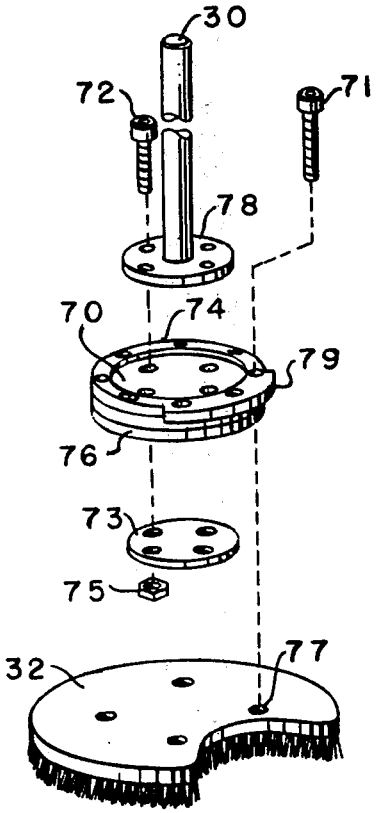
FIG. 9 is an exploded view of a flexible coupling for attaching the brushes to the machine.

It may be advantageous to attach brush 32 to shaft 30 by a flexible coupling as best shown in FIG. 9, wherein the flexible coupling includes upper ring 74, lower ring 76 and flexible disc 70. Normally upper ring 74 and lower ring 76 will be constructed of a rigid material, usually metal, while flexible disc 70 will be constructed of a more yielding material such as rubber. Shaft 30 terminates in mounting plate 78 which engages the center of flexible disc 70. Bolts 72 pass through mounting plate 78, then through flexible disc 70, through retainer 73 and are secured by nuts 75. Brush 32 is secured to the flexible coupling by bolts 71 which pass through upper ring 74, flexible disc 70, lower ring 76 and into threaded holes 77 in brush 32. Advantageously, counterweight 79 may be provided to compensate for the lost weight of the cutout area of brush 32.

This flexible coupling arrangement has a high degree of torsional rigidity while leaving the brush free to deflect to follow the floor. Since the coupling mechanism is torsionally rigid, by providing one for each shaft it is possible to keep brushes 32 and 132 in proper phase with each other so that they do not collide while still allowing sufficient freedom for the brushes to deflect to follow the contours of the floor. In other words, the flexible coupling does not allow the brush to rotate in the plane which is normal to the shaft but allows the angle between the plane of the brush and the axis of the shaft to change slightly so that the brush may follow the contours of the floor.

Figure 11:
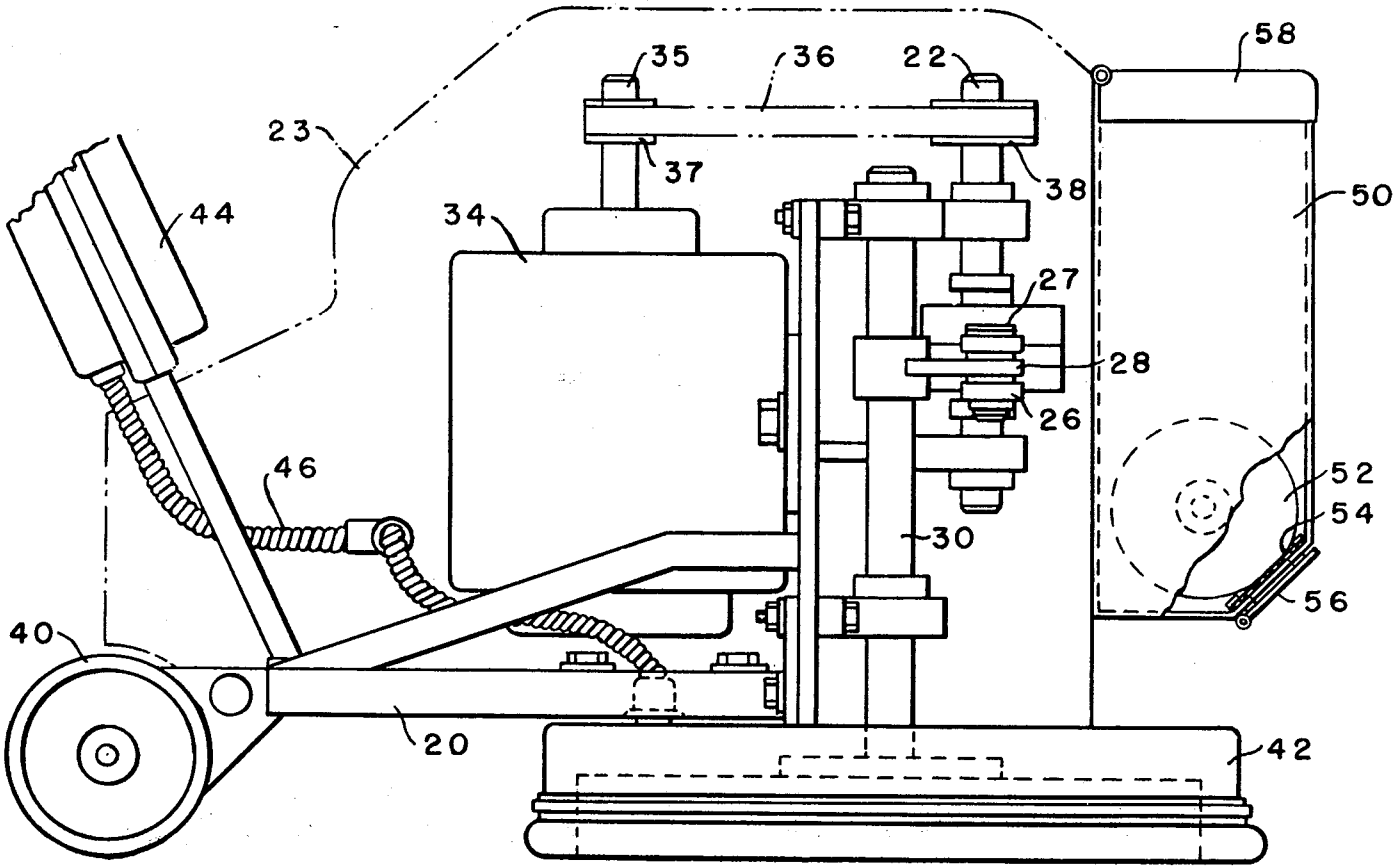
FIG. 11 is a schematic side elevation of the carpet scrubbing machine with cover shown in phantom and modified so that a powder dispensing means can be accommodated.
Figure 12:
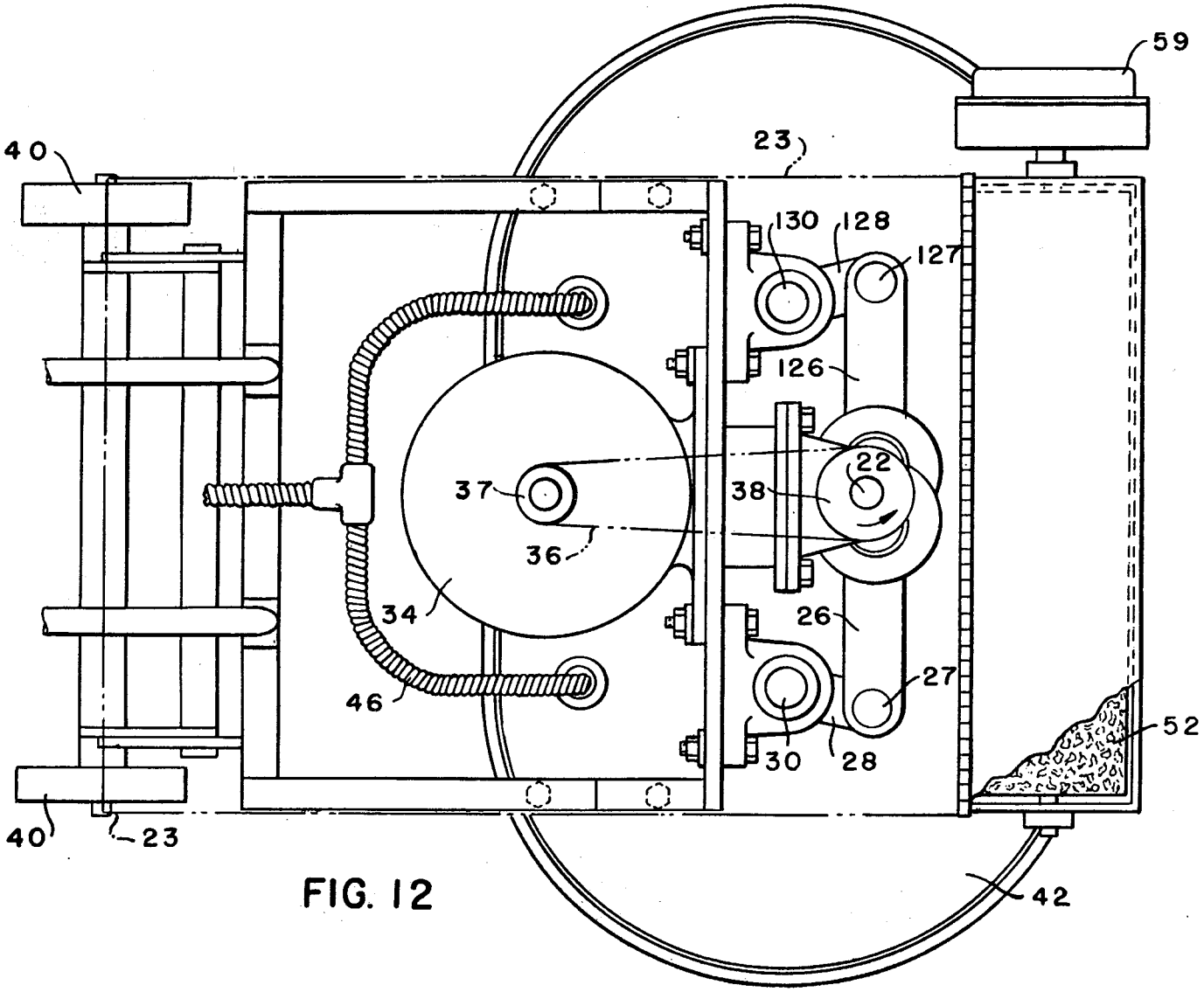
FIG. 12 is a schematic top view of the machine of FIG. 11 with cover shown in phantom.

It has been found to be advantageous to combine a spreader of the type disclosed in U.S. Pat. No. 4,019,662 with the scrubber of the present invention as shown in FIGS. 11, 12 and 13. As shown in FIG. 11, motor 34 is placed to the rear of crankshaft 22 to facilitate mounting of powder storage bin 50 on cover 23 which is mounted on frame 20. Reticulated foam cylinder 52 is rotably mounted within powder storage bin 50 and presses against foraminous discharge area 54. Powder is dispensed by activating auxiliary motor 59 which rotates reticulated foam cylinder 52. Particles of powdered cleaning composition within powder storage bin 50 enter the pores of reticulated foam cylinder 52, are carried into contact with foraminous discharge area 54 by rotation of reticulated foam cylinder 52 and are expelled through the perforations in foraminous discharge area 54. Powder storage bin door 56 and powder storage bin cover 58 provide moisture-tight seals for powder storage bin 50 and minimize the rate at which the powder stored therein dries out. It has been found that powdered cleaning compositions having very high moisture contents may be used in this spreader when it is combined with the scrubber of the present invention. In particular, by placing the spreader ahead of the brushes of the machine of the present invention, it is possible to lay down powdered cleaning composition and scrub it into the pile of the carpet in one pass over the carpet rather than two. It has been found that when the spreader and scrubber are combined as in this apparatus, the application is more uniform and the drying of the powder between application and agitation is minimized and made more uniform.

It is also advantageous to include a vacuum device on the scrubber of the present invention to minimize dusting effects. As can be seen in FIGS. 1, 2, 3, 11, 12 and 13, shroud 42 encompasses brushes 32 and 132 and is connected to vacuum 44 by hose 46. Advantageously, flexible skirt 48 can be added to shroud 42 to enable the device of the present invention to also be used for retrieval of the powdered cleaning composition.

Figure 14:
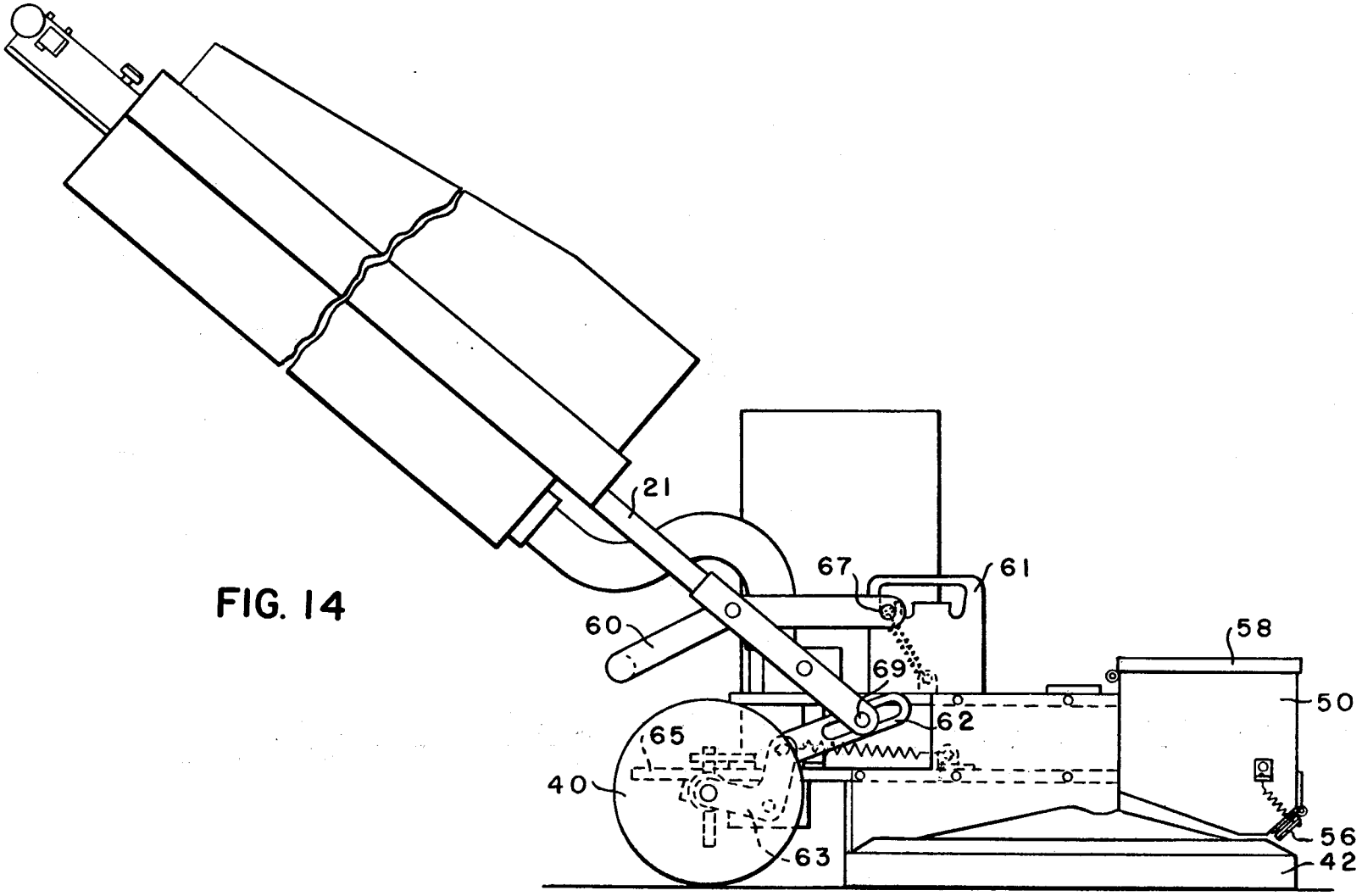
FIG. 14 is a side elevation of a low profile carpet scrubbing machine.
Figure 15:
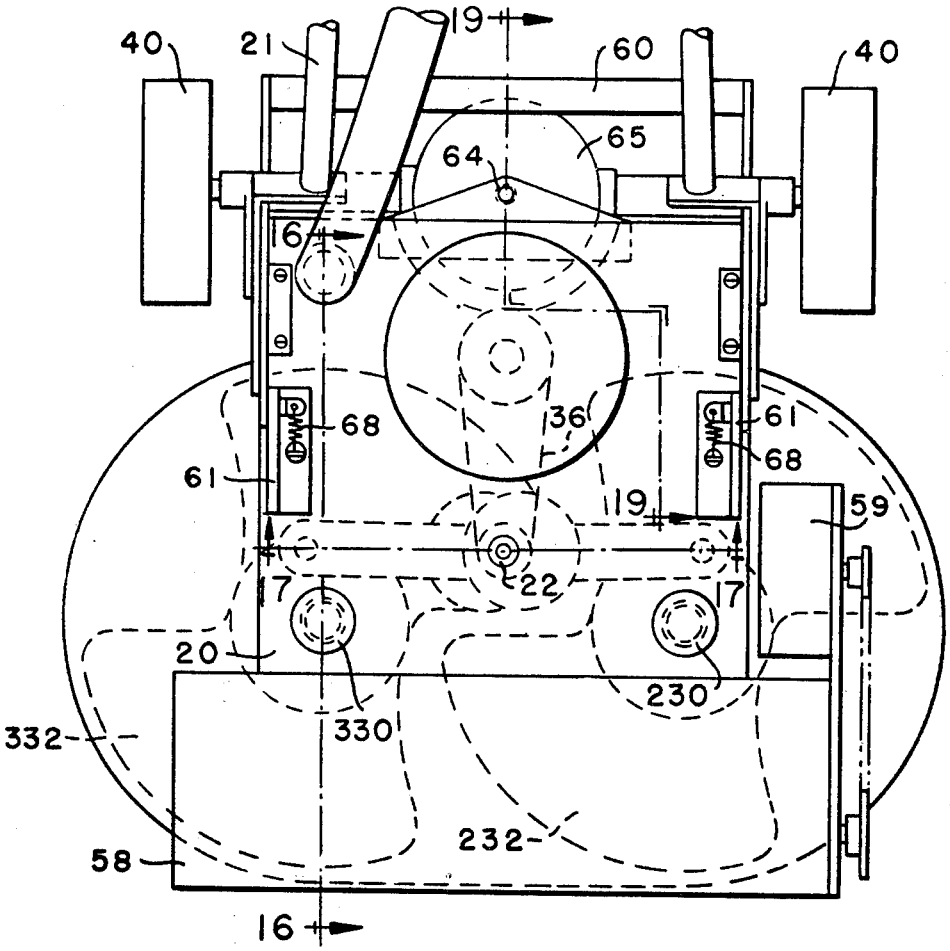
FIG. 15 is a schematic top view of the low profile carpet scrubbing machine.
Figure 17:
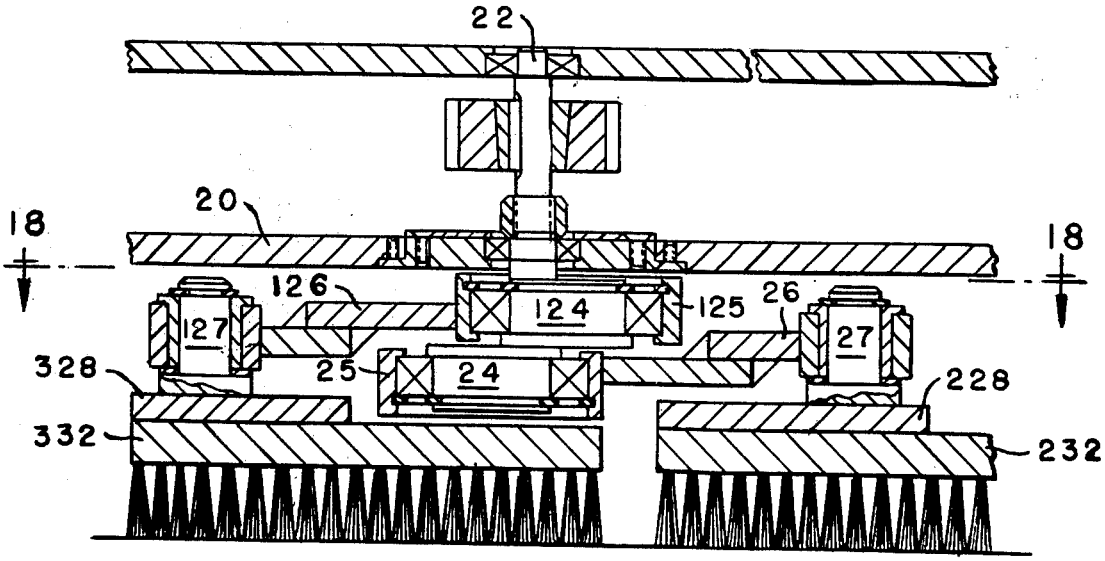
FIG. 17 is a sectional view taken along section line 17—17 of FIG. 15.

The scrubbing machines which are described above and shown in FIGS. 1 through 13 are suitable for scrubbing the carpets in large unobstructed areas but have proved difficult to use in offices and similar areas. To overcome this problem, the low profile scrubber shown in FIGS. 14 through 19 has been designed for use in offices and other confined areas. As shown in FIG. 14, the scrubbing portion of the machine can extend under desks and tables to enable the operator to clean the carpet without moving and rearranging furniture.

Figure 16:
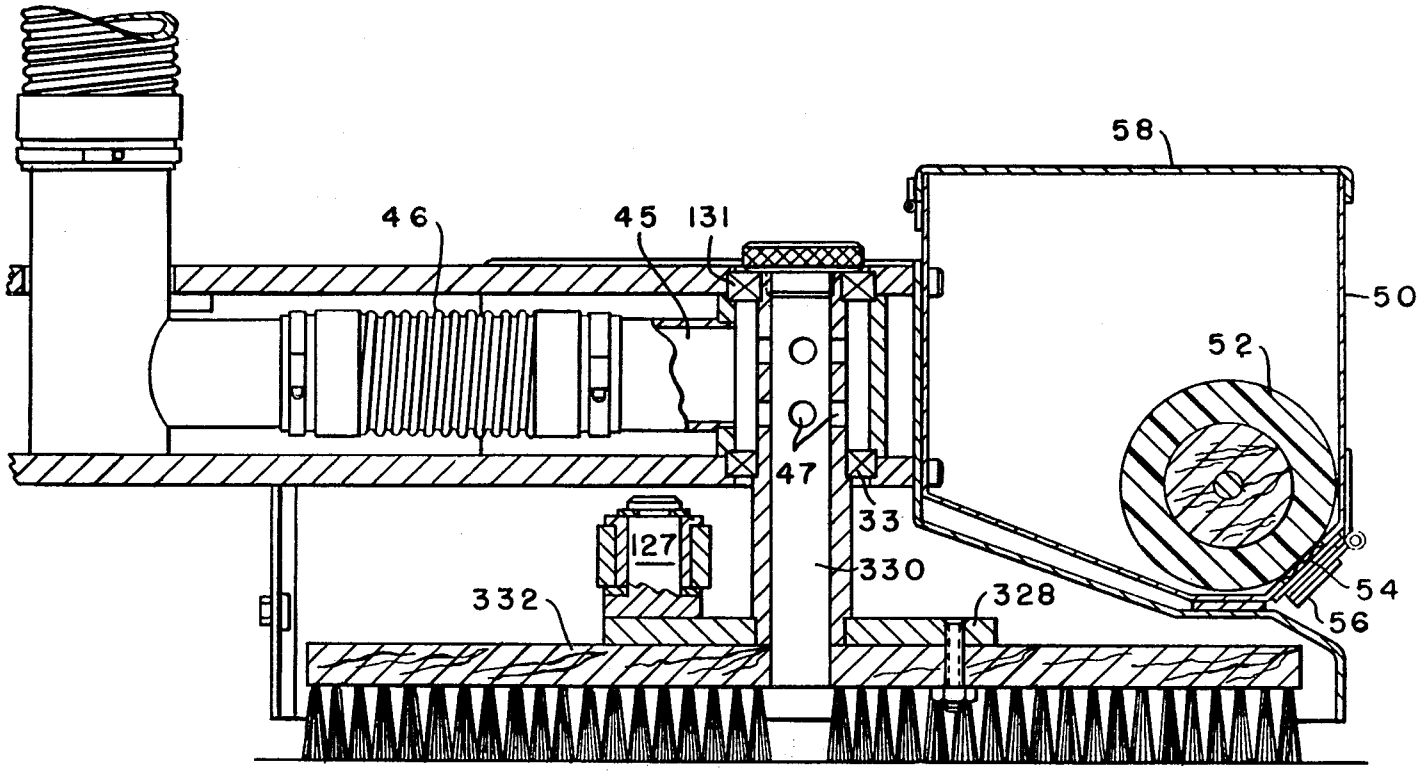
FIG. 16 is a sectional view taken along section line 16—16 of FIG. 15.
Figure 18:
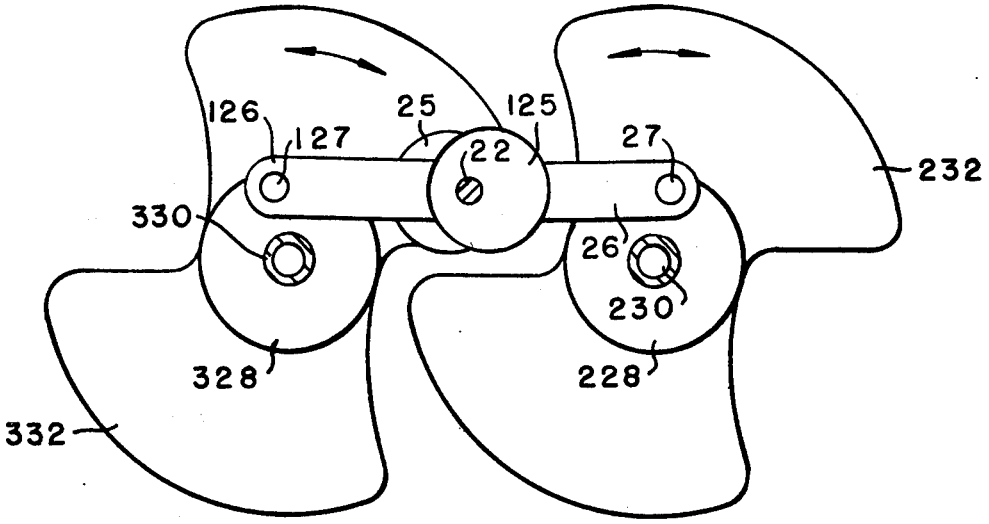
FIG. 18 is a sectional view taken along section line 18—18 of FIG. 17.

The low profile scrubber is similar to the machine described above but, as can be seen in FIGS. 15–18, rocking links 228 and 328 take the form of circular plates which perform the same functions as rocking links 28 and 128 in previous embodiments. Brushes 232 and 332 are directly connected to rocking links 228 and 328 and shafts 230 and 330 are used only to rotatably mount brushes 232 and 332 on frame 20. Brushes 232 and 332 are driven by connecting pins 27 and 127 which are connected to circular plates 228 and 328 which are mounted directly on brushes 232 and 332. To further minimize dusting while also minimizing the height of the machine, shaft 330 is hollow and is connected to vacuum hose 46 through manifold 45 as shown in FIG. 16. Shaft 330 is supported by upper bearing 31 and lower bearing 33 which seal manifold 45 when shaft 330 is in place. Hollow shaft 330 has holes 47 which open into the interior of manifold 45 allowing communication between the interior of shaft 330 and vacuum hose 46. Hollow shaft 330 is similarly connected to vacuum means 44.

Figure 19:
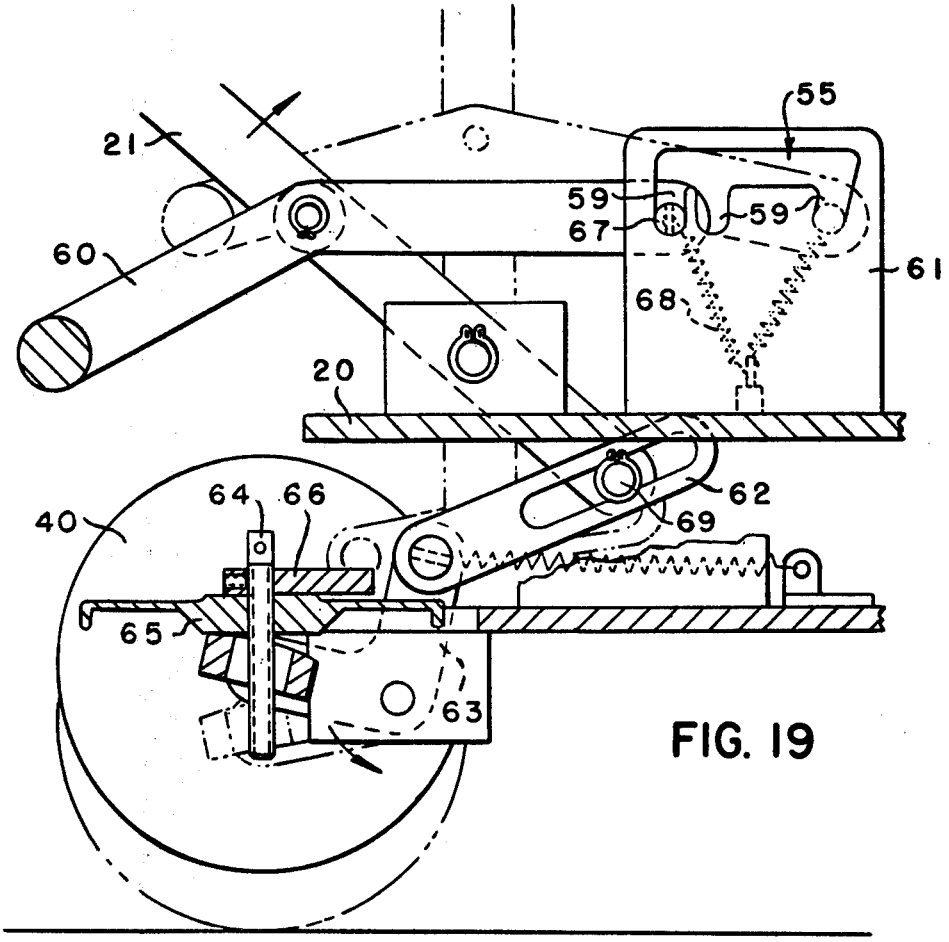
FIG. 19 is a sectional view taken along section line 19—19 in FIG. 15.

Since brushes 232 and 332 angularly oscillate, it is desirable that the weight of the machine be removed from brushes 232 and 332 when the machine is being stored. This prevents the bristles in brushes 232 and 332 from acquiring an undesirable set or permanent lean in one direction which would tend to reduce the uniformity of cleaning. To prevent the bristles from acquiring this undesirable set, means are provided for withdrawing the weight of the machine from the brushes when handle 21 is moved into its upright position. This means for withdrawing the weight of the machine from the brushes includes a means for moving wheels 40 from an upper position to a lower position when handle 21 is moved into its upright or fully erect position. When wheels 40 are moved into their lower position, the weight of the machine is fully supported by wheels 40 and the front edge of shroud 42. As best shown in FIG. 19, handle 21 is pivotably mounted on frame 20 and retaining yoke 60 is pivotably mounted on handle 21. Slotted retaining plates 61 are mounted on frame 20 and each has a slot 55 with a plurality of detents 59 formed therein which detents 59 engage retaining pins 67 mounted on each end of retaining yoke 60. Handle 21 is held in operating position by retaining yoke 60 which in turn is held in position by retaining pins 67 engaging detents 59 in retaining plates 61. Retaining yoke 60 is held in position by retaining springs 68 which hold pins 67 into any of the selected detents 59 in slots 55 in retaining plates 61.

Actuating pins 69 are mounted on the lower ends of handle 21 and engage the slots in slotted intermediate arms 62. The rear end of each slotted intermediate arm 62 is pivotably joined to one of the pivoting L-shaped support members 63 which are pivotably mounted on frame 20. Wheels 40 are mounted on pivoting L-shaped support member 63. Adjusting disc 65 has a threaded aperture which engages threaded adjusting rod 64 which is mounted on frame 20. Adjusting disc 65 engages pivoting L-shaped support member 63 when wheels 40 are in the upper position. By rotating adjusting disc 65, the operator can adjust the operating position of the wheels so that carpets having piles of varying lengths may be accommodated.

The operator can move handle 21 into the upright or storage position by rotating retaining yoke 60 counterclockwise against the force of retaining springs 68. This removes retaining pins 67 from detents 59 in retaining plates 61 and allows the operator to pivot handle 21 into the upright position. Retaining spring 68 urges retaining pins 67 into detents 59 in the retaining plates 61 and prevents further movement of handle 21 unless retaining yoke 60 is again pivoted counterclockwise. When handle 21 is pivoted to the storage position, actuating pins 69 move within the slots in slotted intermediate arms 62. Upon reaching the end of the slot in each slotted intermediate arm 62, each actuating pin 69 then exerts a rearward force on each slotted intermediate arm 62 and causes pivoting L-shaped support members 63 to be rotated counterclockwise. Since wheels 40 are rotatably mounted on pivoting L-shaped support member 63, this forces wheels 40 into the lower position and lifts the weight of the machine off of the brushes 232 and 332.

That which is claimed is:

1. A device for scrubbing surfaces, comprising:

a frame;

a scrubber means adapted to angularly oscillate in the tangent plane of said surface;

means for mounting said scrubber on said frame and angularly oscillating said scrubber means including, a crankshaft, mounted on said frame, adapted for rotation about its longitudinal axis and having a driving portion which is offset from the longitudinal axis of said crankshaft;

a coupling link, one end of which is pivotably attached to the driving portion of said crankshaft;

a rocking link, one end of which is pivotably attached to the other end of said coupling link; and a drive shaft substantially parallel to said crankshaft, adapted for angular oscillation about its longitudinal axis, one end of which is rigidly attached to the other end of said rocking link, the other end of which is attached to said scrubber means; and means for guiding the device.

2. A device for scrubbing surfaces, comprising:

a frame;

a scrubber means adapted to angularly oscillate in the tangent plane of said surface;

means for mounting said scrubber on said frame and angularly oscillating said scrubber means;

means for guiding the device; and means mounted on said frame for dispensing powdered cleaning composition.

3. The device of claim 2 wherein said means for dispensing powdered cleaning composition includes:

a powder storage bin mounted on said frame having a foraminous wall discharge area;

a cylinder of pore bearing resilient reticulated foam rotatably mounted within said bin and disposed such that on rotating, it presses against the wall discharge area forcing said powder through said foraminous wall area; and means for rotating said cylinder.

4. The device of claim 3, further comprising:

vacuum means mounted on said frame;

a shroud mounted on said frame and encompassing said scrubber means, and operably connected to said vacuum means; and a flexible skirt member mounted on said frame and extending around the periphery of said shroud and extending substantially to the surface to be scrubbed.

5. The device of claim 1, further comprising:

vacuum means mounted on said frame;

a shroud mounted on said frame, encompassing said scrubber means and operably connected to said vacuum means; and a flexible skirt member mounted on said frame and extending around the periphery of said shroud and extending substantially to the surface to be scrubbed.

* * * * *